US009814989B2

(12) United States Patent
Gustafson

(10) Patent No.: US 9,814,989 B2
(45) Date of Patent: Nov. 14, 2017

(54) PORTABLE ZIP LINE SYSTEM

(71) Applicant: Steven R. Gustafson, Rockford, IL (US)

(72) Inventor: Steven R. Gustafson, Rockford, IL (US)

(73) Assignee: Experience Based Learning, Inc., Rockford, IL (US)

( * ) Notice: Subject to any disclaimer, the term of this patent is extended or adjusted under 35 U.S.C. 154(b) by 0 days.

(21) Appl. No.: 14/875,451

(22) Filed: Oct. 5, 2015

(65) Prior Publication Data

US 2017/0095743 A1 Apr. 6, 2017

(51) Int. Cl.
*B61B 7/00* (2006.01)
*A63G 21/22* (2006.01)

(52) U.S. Cl.
CPC ..... *A63G 21/22* (2013.01); *B61B 7/00* (2013.01); *A63G 2200/00* (2013.01)

(58) Field of Classification Search
CPC .. A63G 21/22; B61B 7/00; B61B 7/02; B61B 7/04; B61B 7/06
See application file for complete search history.

(56) References Cited

U.S. PATENT DOCUMENTS 378,154 A 2/1888 Zandt
403,603 A 5/1889 Newcomb
837,480 A 12/1906 Lee
952,673 A * 3/1910 Karr ..... A63G 3/00 104/113
1,141,919 A * 6/1915 Auchu ..... A62B 5/00 182/115
1,422,032 A 7/1922 Chapman
4,159,113 A * 6/1979 Callecod ..... A63B 7/00 104/112
4,830,144 A * 5/1989 Werner ..... E04G 1/14 182/119
4,858,726 A * 8/1989 Preston ..... E04G 1/34 182/112
6,953,106 B2 * 10/2005 Weston ..... E04G 5/16 182/115
8,708,109 B2 * 4/2014 Steele ..... A63G 21/22 104/113
8,985,028 B2 * 3/2015 Gustafson ..... A63G 21/22 104/112
2002/0169052 A1 * 11/2002 Godsey ..... A63B 69/0048 482/37
2003/0013579 A1 * 1/2003 Rennex ..... A63B 7/04 482/37
2006/0157298 A1 * 7/2006 Beggrow ..... A62B 35/0056 182/36

(Continued)

*Primary Examiner* — Jason C Smith
(74) *Attorney, Agent, or Firm* — Reinhart Boerner Van Deuren P.C.

(57) ABSTRACT

A portable zip line tower is provided. The portable zip line tower comprises a tower structure having a major longitudinal axis. The tower structure is configurable into a first configuration wherein the major longitudinal axis is generally parallel to ground and a second configuration wherein the major longitudinal axis is generally perpendicular to ground. At least one platform mounted at least partially within an interior space of the tower structure and the tower structure is configured for mobile transportation in the first configuration.

21 Claims, 7 Drawing Sheets

(56) References Cited

U.S. PATENT DOCUMENTS

| | | | | |
|---|---|---|---|---|
| 2008/0011183 | A1* | 1/2008 | Fischer | A63G 21/22 104/123 |
| 2008/0229967 | A1* | 9/2008 | Lins | A63G 21/22 104/173.1 |
| 2009/0266267 | A1* | 10/2009 | Moss | A63G 21/20 104/53 |
| 2011/0239895 | A1* | 10/2011 | Liggett | A63G 21/22 104/113 |
| 2013/0239842 | A1* | 9/2013 | Boren | B61B 7/00 104/113 |
| 2013/0239843 | A1* | 9/2013 | Boren | B61B 12/00 104/117.1 |
| 2014/0182477 | A1* | 7/2014 | Gustafson | B61B 7/00 104/113 |
| 2015/0051006 | A1* | 2/2015 | Checketts | A63G 21/20 472/118 |
| 2016/0075343 | A1* | 3/2016 | Chasteen | A63G 21/22 104/178 |
| 2016/0193535 | A1* | 7/2016 | Dose | A63G 21/22 104/113 |

* cited by examiner

PORTABLE ZIP LINE SYSTEM

FIELD OF THE INVENTION

This invention generally relates to recreational zip line systems and more particularly to the structures used to support them.

BACKGROUND OF THE INVENTION

Zip line systems comprised of zip line towers for zip line rides are well known and as disclosed in my previous U.S. Pat. No. 8,985,028, include permanent support structures in the ground that fix the geographic location/venue of where zip line riders may find recreational zip line rides. The zip line towers of such traditional zip line rides may be comprised, for example, of poles that support landing platforms for zip line users. The poles are generally driven into the ground such that cement footings may be formed so as to fix the zip line ride in place for stability. Accordingly, one of the disadvantages of such zip line ride systems is that they may not be easily disassembled, transported from one venue to another venue and then easily reassembled for use because their tower structures are fixed in the ground. Accordingly, their removal is costly in terms of the equipment required and labor needed to disassemble such a permanently fixed zip line towers for transport.

Further, the cost of building fixed zip line rides in multiple geographic locations is cost prohibitive considering not only the cost of labor for each new construction but the rental and or purchase of the real estate where the zip line towers for zip line rides are desired. Moreover, a traditional fixed zip line ride that must have support structures permanently fixed in the ground limits the venues where the towers for the zip line rides may be utilized. For example, such zip lines rides would not be found at an outdoor concert or at sporting events or county fairs to name just a few examples where there are large customer bases/users but no ability to serve them with zip line rides because permanent zip line towers may not be permitted or desired at such venues.

Accordingly, establishing fixed zip line rides for such limited events with large numbers of potential users may not only be cost prohibitive but geographically not possible. In other words, a permanent zip line tower cannot be put in place in a concrete parking lot for example or zoning for such a permanent structure prevents construction in the desired location. Therefore, there is a need in the art for a zip line system that addresses these disadvantages.

The invention provides such a zip line system. These and other advantages of the invention, as well as additional inventive features, will be apparent from the description of the invention provided herein.

BRIEF SUMMARY OF THE INVENTION

The present invention is generally directed to a portable zip line system interchangeably referred to as a portable zip line tower.

In one aspect, the invention provides for a portable zip line tower that is comprised of a tower structure having a major longitudinal axis. The tower structure is configurable into a first configuration wherein the major longitudinal axis is generally parallel to ground and a second configuration wherein the major longitudinal axis is generally perpendicular to ground. The portable zip line tower includes at least one platform mounted at least partially within an interior space of the tower structure. The tower structure is configured for mobile transportation in the first configuration.

In another aspect, the invention provides a portable zip line tower that includes a tower structure comprising a plurality of walls which surround and enclose an interior space. The tower structure includes at least one platform mounted at least partially within the interior space. The tower structure includes at least one platform mounted such that at least one zip line cable of the zip line tower terminates proximate the at least one platform. Additionally, the tower structure includes at least one selectively openable and closeable barrier formed in at least one of the plurality of walls. The at least one selectively openable and closeable barrier providing access to said at least one platform.

In an embodiment the tower structure may include four side walls, a top wall, and a bottom wall defining the interior space.

In another embodiment, at least one selectively openable and closeable barrier may be formed in at least one of the plurality of walls proximate the platform.

In yet another embodiment the at least one platform may be mounted such that the at least one zip line cable of the portable zip line tower terminates proximate the at least one platform.

In another embodiment, in the second configuration and at least one free fall support structure may be releasably connected to the tower structure and extend generally perpendicular to at least one of the four side walls.

In another embodiment, at least one of the four side walls may be a rock climbing wall.

In another embodiment, a second platform is at least partially within the interior space and wherein the second platform is mounted spaced apart from the top, the bottom and the first platform.

In an embodiment the plurality of walls are four side walls, a top wall and a bottom wall.

In another embodiment a second platform is spaced from the first platform the top wall and the bottom wall. The second platform is mounted at least partially within the interior space.

In yet another embodiment, the at least one selectively openable and closeable barrier is formed in the top wall.

In another embodiment, the at least one selectively openable and closeable barrier is formed in one of the side walls.

In still another embodiment, assent-descent means for reaching the at least one platform extend from proximate the bottom wall to proximate the first platform.

In another embodiment, a second selectively openable and closeable barrier is formed in the top wall.

In an embodiment, at least one zip line is removably connected to the tower structure.

In an embodiment, at least one free fall support structure is releasably connected to the tower structure and extends generally perpendicular to at least one of the plurality of walls.

In an embodiment, at least one of the plurality of walls displays advertisements.

In yet another aspect, the invention provides a method for operating a portable zip line tower. The method includes the steps of removing a zip line tower from a mobile transport and the step of standing up the zip line tower such that a major longitudinal axis of the zip line tower extends generally normal to the ground.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
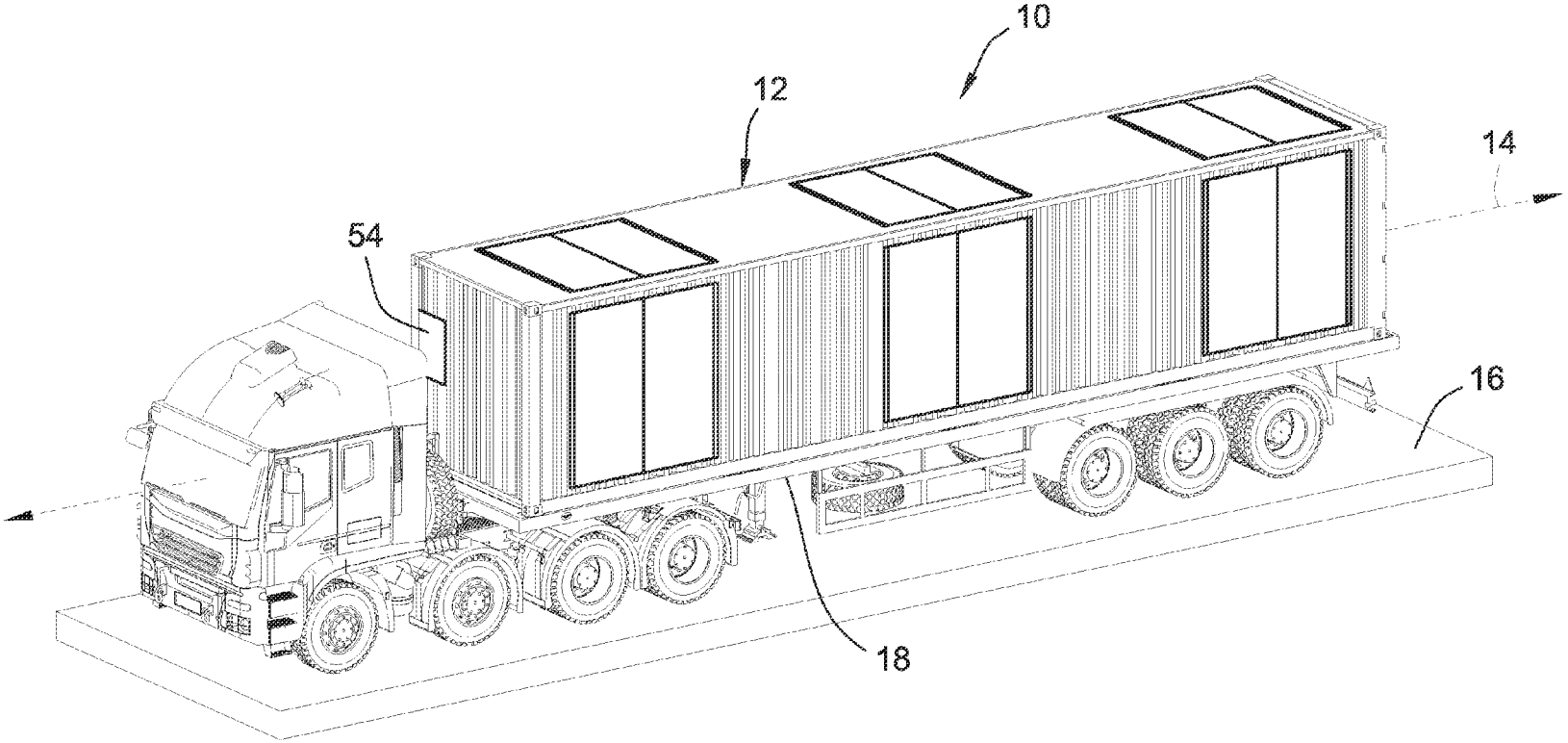
FIG. 1 is an illustration of an embodiment of a portable zip line tower of the present invention in a first configuration and being transported by a tractor trailer.

FIG. 1 illustrates an embodiment of a portable zip line tower 10 being transported by tractor trailer 18. As shown in FIG. 1, the zip line tower 10 is comprised of a tower structure 12. The tower structure 12 is configurable into a first configuration for mobile transport. By configurable into a first configuration for mobile transport it is meant that the tower structure 12 has its major longitudinal axis 14 extending generally parallel, that is, within 10 degrees of the flat plane of ground surface 16. Accordingly, FIG. 1 illustrates the tower structure 12 is configured in its first configuration and may be referred to as laying down.

Figure 2:
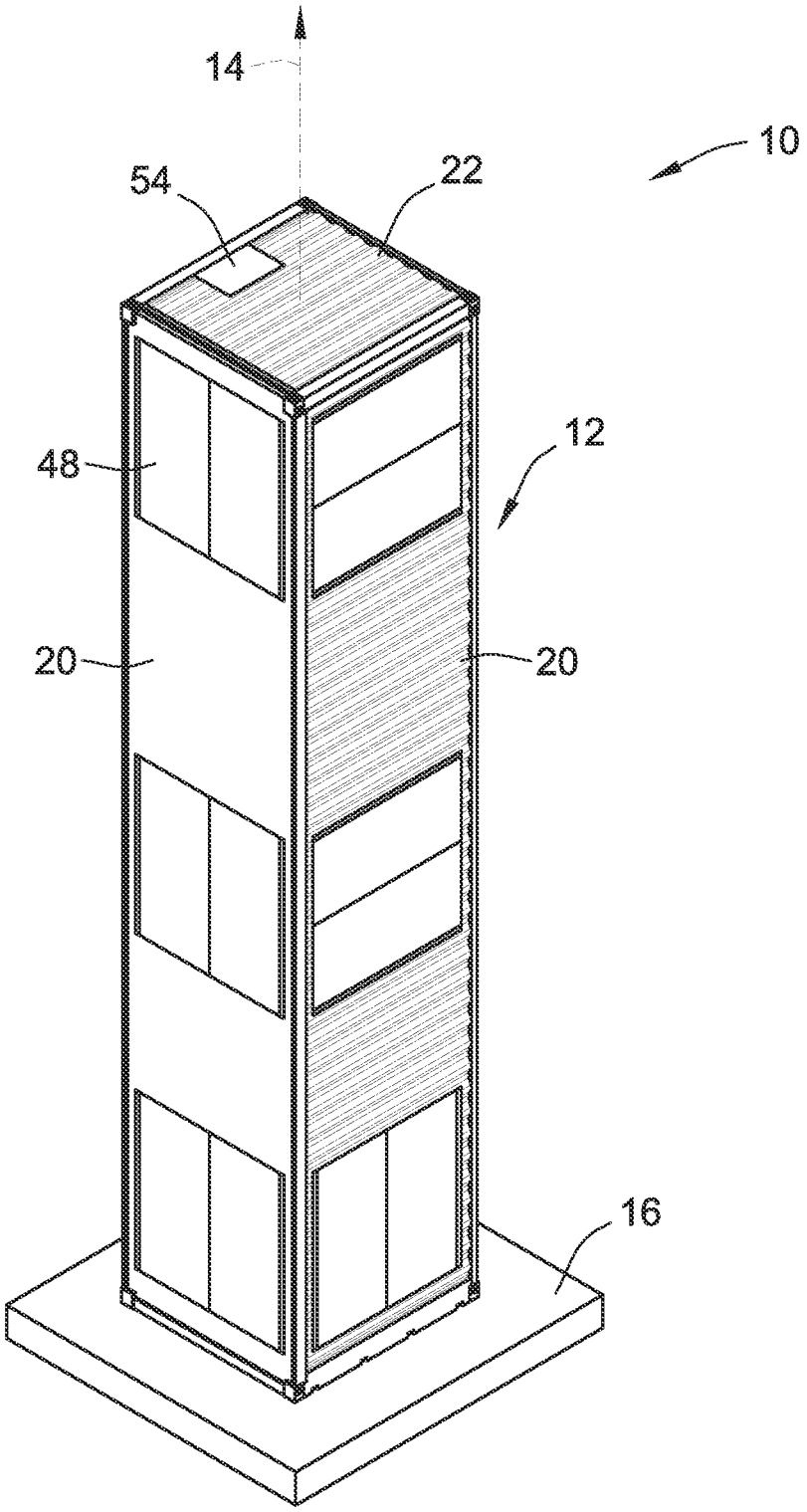
FIG. 2 is a perspective view of an embodiment of a portable zip line tower of the present invention in a second configuration.

Turning now to FIG. 2, the tower structure 12 is illustrated as configured in a second configuration. By second configuration it is meant that the major longitudinal access 14 of the tower structure 12 is generally perpendicular to the ground 16. Generally, perpendicular is understood as an angle of 90 degrees, plus or minus 10 degrees, between the plane through which the major longitudinal axis 14 of the tower structure 12 extends and the flat plane defined by the surface of the ground 16. Accordingly, the angle between the major longitudinal axis 14 and ground 16 in the second configuration is generally 90 degrees greater than the angle between the ground 16 and the major longitudinal axis in the first configuration.

Figure 3:
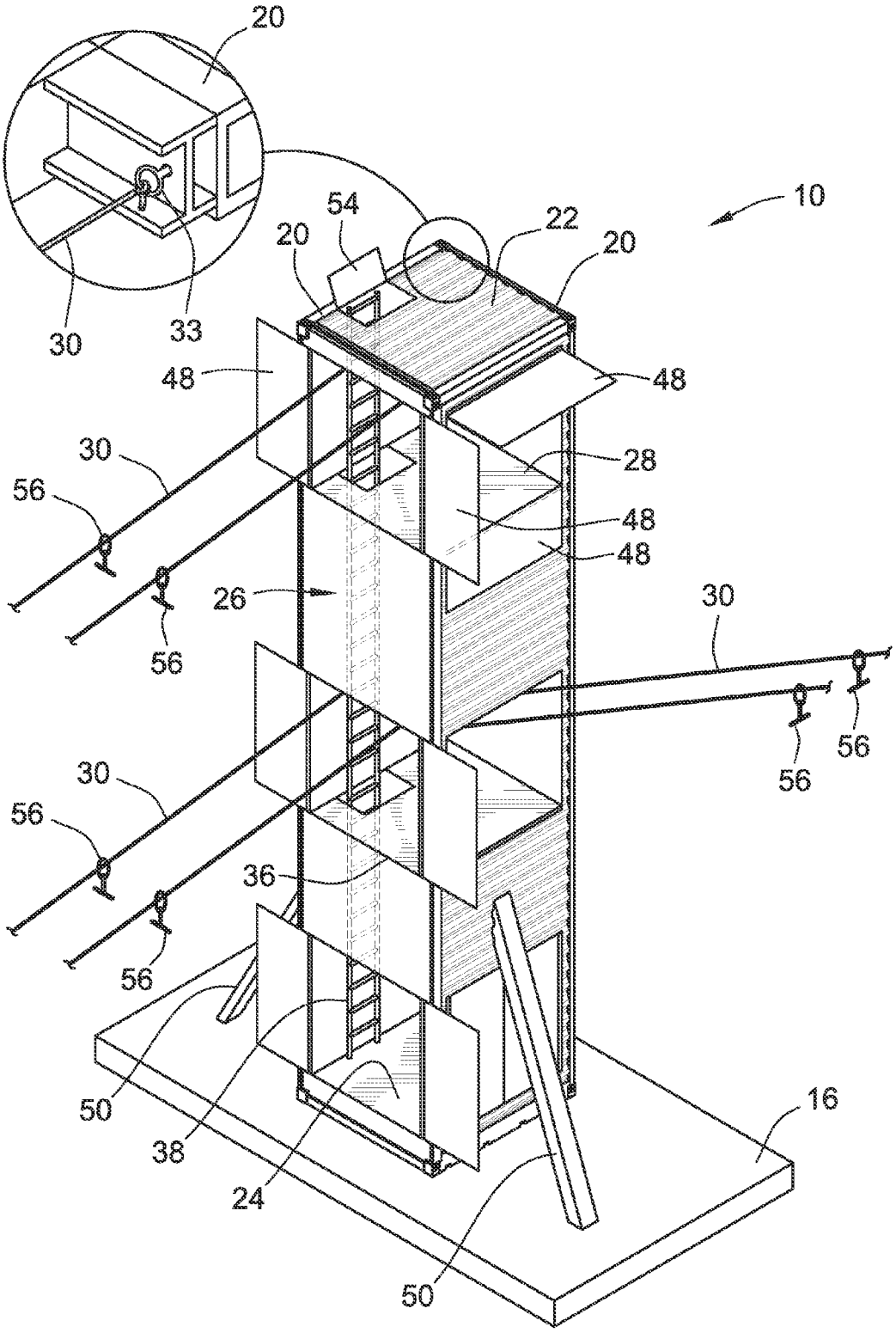
FIG. 3 is a perspective view of an embodiment of a portable zip line tower of the present invention.

As illustrated in FIG. 2 and FIG. 3, the tower structure 12 includes a plurality of walls 20, 22, 24. The plurality of walls form the tower structure 12 as a box having four sidewalls 20, a top wall 22, and a bottom wall 24. The walls 20, 22, 24 define and surround an interior space 26. The tower structure 12 allows it to be free standing vertical position for use. By vertical is meant the major longitudinal axis 14 of the box extends generally perpendicular to the ground upon which bottom wall 24 sits through the top wall 22. Thus, the tower structure 12 is referred to as standing up and as illustrated in FIGS. 2 and 3 is in its second configured state as opposed to lying down as illustrated in FIG. 1 when in its first configured state.

By free standing it is meant that the tower structure 12 may be placed on its bottom 24 such that the tower structure 12 extends vertically meaning that its major longitudinal axis 14 extends from its top wall 22 to its bottom wall 24 generally perpendicular to the ground 16 and no other support is required for the tower structure 12 to remain vertical/standing up.

Thus, advantageously, free standing tower structure 12 does not require traditional zip line towers with support poles or structures fixed in the ground. Although permanent support structures are not required for utilizing embodiments of the tower structure 12, it is contemplated that where conveniently located, permanent structures or even stabilizing support element/s 50 (FIG. 3) such as upriggers may be releasably connected to the tower structure 12 to provide added safety and stability when desired.

Although the tower structure 12 as illustrated in FIGS. 2 and 3 has a plurality of walls comprising six walls, it is not the intent to limit the embodiments to the number of walls illustrated. For example, it can be readily appreciated by those skilled in the art that the tower structure 12 could have a plurality of walls defining a pyramidal structure (not illustrated) for example or pentagonal structure (not illustrated) to list a few non-limiting examples. Such embodiments may provide the desired free standing tower structure that is both transportable and free standing and which can be utilized as a zip line tower.

Still with respect to FIGS. 2 and 3, a selectively openable and closeable barrier 48 is shown as formed in sidewall 20. The selectively openable and closeable barrier 48 may be in the form of a pair of doors with hinges that open and close to provide access to an interior space 26 of the tower structure 12. Accordingly, during transport the selectively openable and closeable barrier 48 may be closed (FIG. 1) and then opened to provide access to the interior space 26 when the tower structure 12 is in use. (FIGS. 2 and 3)

A second selectively openable and closeable barrier 54 may also be provided in top wall 22. It is not the intent to limit embodiments of the selectively openable and closeable barriers 48 and 54 to either the locations illustrated or to doors. That is, any structures that may open the walls 20, 22, 24 for access to the interior 26 and permit the closure of the walls to separate the interior 26 from the external environment are contemplated. Some non-limiting examples include, a single hinged door that swings open in a right to left manner or left to right or that opens vertically may be utilized. Other embodiments may use a single plate that may be easily bolted or unbolted and then removed to open the wall 20 or 22 or seal the walls 20, 22 closed.

Further, it is not the intent to limit the embodiments of the tower structure 12 to the seven locations illustrated for the selectively openable and closeable barriers 48, 54 as illustrated in FIGS. 2 and 3. For example, an embodiment may have an entire tower structure 12 with no selectively openable and closeable barriers 48 at all or a single barrier 48 in only one of the walls 20. On the other hand, other embodiments may have a single selectively openable and closeable barrier 48 on one wall 20 but two or three selectively openable and closeable barriers 48 or more on adjacent or opposing walls 20. Other embodiments may have more than one selectively openable and closeable barrier 54 in the top wall 22 or bottom wall 24 or none at all. However, where the selectively openable and closeable barriers 48 are present on side walls 20 then their dimensions may be those understood by those skilled in the art to provide adequate clear space above, below, and around the selectively openable and closeable barrier 48 to ensure users of the zip line ride will not strike or contact any permanent or transient structure on or in the tower structure 12 except a platform 28, 36 provided as a zip line landing area. The same dimensions are not required for the barrier 54 in top wall 22. This is so because selectively openable and closeable barrier 54 need only be dimensioned such that a user may pass from the interior space 26 to the top wall 22 by means of passing through the selectively openable and closeable barrier 54 in an open state.

Comparing FIGS. 1 and 2 illustrates several advantages disclosed in the embodiments. For example, as illustrated, the tower structure 12 may be a general intermodal container which is simply a standardized shipping box. These boxes are often times referred to as containers or conex boxes and are generally constructed of steel and mass produced allowing for low cost and ease of availability and ready modification. For example, referring to the selectively openable and closeable barriers 48, because of the numbers of conex boxes available on the market, numerous enterprises including original equipment manufacturers have the means to readily modify the containers and thus fabricate the type and location of the selectively openable and closeable barriers 48, 54 as heretofore described. Selectively openable and closeable barriers 48, 54 need not be made of the same material as tower structure 12.

Embodiments, such as those in FIGS. 2 and 3, that utilize containers/conex boxes as tower structures 12 advantageously may be ordered in standard sizes from suppliers. Some of the non-limiting standard sizes contemplated in embodiments for use as tower structures 12 include those that are 20 or 40 ft. (6 or 12 meters) in standard length, 8 ft. 6 in. (2.6 meters) and 9 ft. 6. in. (2.9 meters) in height and 8 feet (2.48 meters) in width with standard empty weights that may be 4,850 lbs. (2,200 kg) or 8,380 lbs. (3,800 kg).

Although standard container boxes provide for lower costs, it is not the intent to limit the embodiments to only steel construction or the standard dimensions discussed. For example, other metals, woods, composite or combinations thereof are contemplated provided they are readily transportable and free standing for utilization as tower structures for user of the zip line rides provide by the tower structures.

An advantage of utilizing a standard intermodal container/conex box is not only the low cost but the number of available means of standard transports that are widely available for transporting these standard container box sizes and as such readily able to transport such boxes fabricated to act as self-contained zip line towers. For example, these standard containers, and hence the zip line tower structure 12, are readily transported by tractor trailers, rail cars and ships. Thus, the zip line tower 10 is advantageously easily transported between desired venues. By way of a non-limiting example, the zip line ride may be set up at a state fair one weekend, disassembled, transported to sports stadium parking lot where it again assembled and ready for use by users on the following weekend.

Figure 5:
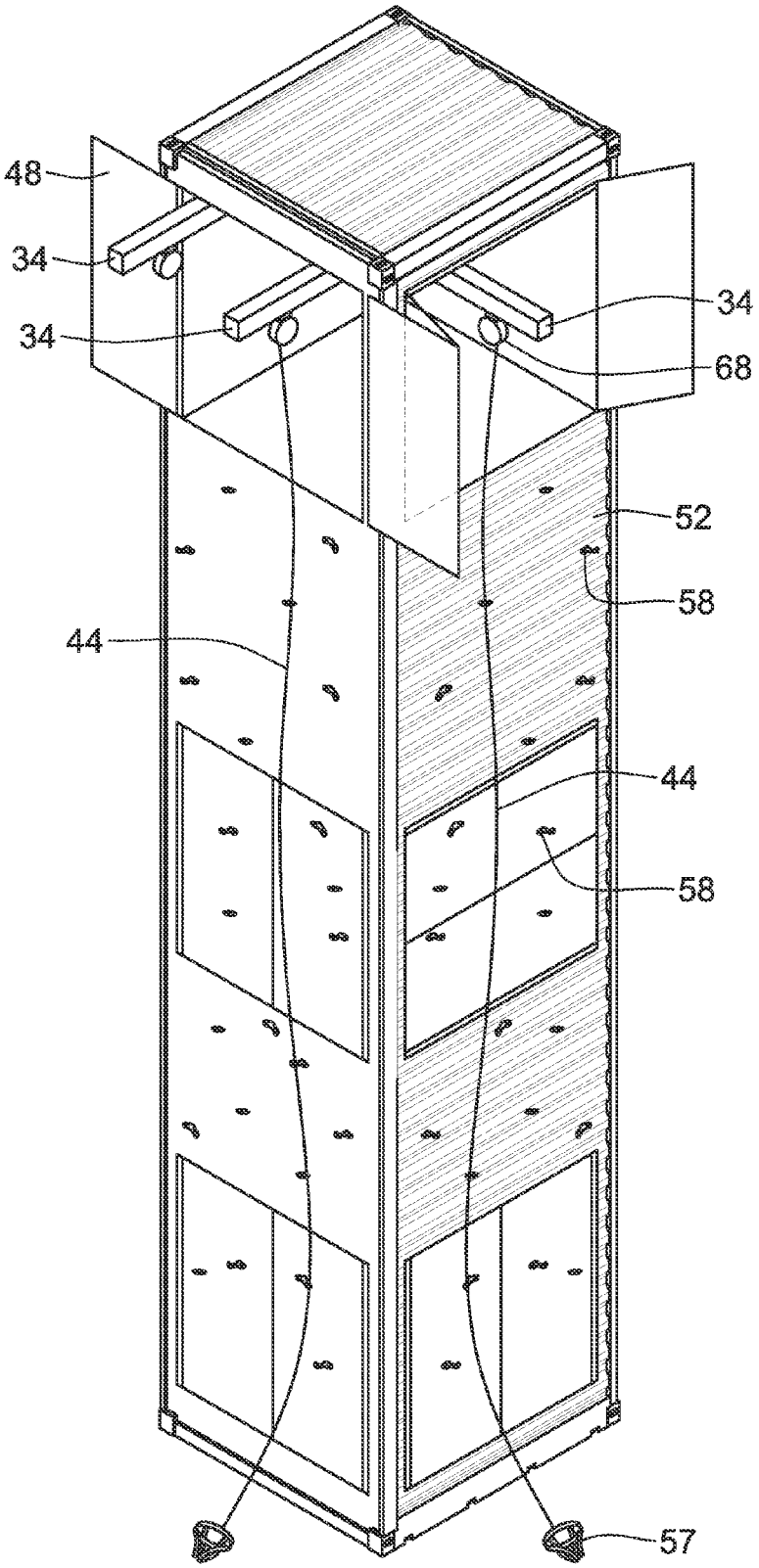
FIG. 5 is a perspective view of an embodiment of a portable zip line tower of the present invention.

As shown in FIG. 2, the tractor trailer 18 which is utilized to transport the tower structure to the desired venue/location is not required to support the tower structure 12. The tower structure 12 is free standing and thus completely free of its means of transport. As such it has the advantage of being surrounded by a greater free area around the tower 10 to advantageously providing greater safety for the users (there is no vehicle to fall into or on) of the zip line tower 10 and greater versatility in the number of uses of the zip line tower 10. This is so, because one of the walls 20 that may have been used to connect to the transportation means is completely free of that connection thereby allowing the wall 20 to be utilized for numerous uses. As a non-limiting example, the wall 20, without the connection to its transport is now free to be used as a rock climbing wall 58 (FIG. 5).

FIG. 3 illustrates the zip line tower 10 standing up in its second configuration. In the embodiment illustrated, each of the sidewalls 20 have three selectively openable and closeable barriers 48 formed as pairs of doors that may be opened to provide access to the interior 26 of the tower structure 12 or closed to seal the interior 26 from the outside environment and secure the zip line tower 10 for transport. Such selectively openable and closeable barriers 48 also advantageously provide for a water tight barrier which allows the tower structure 12 to be transported in inclement weather without its interior 26 being exposed to various harmful environmental elements such as rain or snow for example.

Further, in the embodiment illustrated an at least one platform 28, 36 is shown mounted at least partially within the interior space 26. The platform 28, 36, may be of the same steel construction as the standard containers heretofore described. However, other embodiments may utilize metals, woods, composites or combinations thereof provided they are capable of supporting the weight of at least one zip line user and safety attendant. In other words, the platforms 28, 36 must conform to the standards known by those skilled in the art and in conformity with known ANSI/ASSE standards for platforms for zip line towers.

The platform 28, 36 may be at least partially within the interior space 26 but configurable to be completely enclosed by the plurality of walls of the tower structure as illustrated in FIG. 3. In this way, the tower structure 12 may be completely closed (FIG. 1) and thereby self-contained to allow for ease of transport, assembly and disassembly.

Accordingly, the platform 28, 36 may extend externally from the interior space 26 of the tower structure 12 through a selectively openable and closeable barrier 48. In said embodiments where the platform at least partially extends externally, that is radially outward of a side wall 20, the platforms 28, 36 is configurable to be completely enclosed, that is surrounded by the plurality of walls such that the platform does not extend beyond the walls of the tower structure. By way of example, a platform may be located partly within the interior space 26 and extending beyond the side walls 20 in its first state but in its second state it is configurable, for example by folding via hinge (not illustrated) or a releasably connected fastening means such as a bolt, or other known means so that the platform is completely surrounded by the walls of the tower structure such that the tower structure is entirely self-contained. In such embodiments the selectively openable and closeable barrier 48 is opened and the platform 28, 36 is allowed to extend through the selectively openable and closeable barrier 48. Accordingly, the platforms may have a first state (extending through the selectively openable and closeable barrier 48) and then a second state where the platform 28, 36, maybe folded or an exterior portion, that is the portion extending radially beyond side wall 20 may be removed such that selectively openable and closeable barrier 48 may close the side wall 20 to close the tower body 12 for weather proof storage and or transport.

Other embodiments may provide that the platform 28, 36 remains completely within the interior space 26 during use and transport and never extend radially outward of a side wall 20. The platform 28, 36 may be secured in the interior space 26 to the tower structure 12 by means well known in the art. A few non-limiting examples may be by welding the platform 28, 36 at its outermost peripheral edges to the tower structure 12, fastening means such as bolts, or slots or grooves of an interior surface of the tower structure 12 into which the platform may slide.

Still with reference to FIG. 3, the tower structure 12 may have a single platform 28 or 36 or a plurality of platforms 28, 36 depending on the desired use. Where there are a plurality of platforms, for example the two platforms 28, 36 as illustrated, the first platform 28 is axially spaced from the top wall 22 and axially spaced from the second platform 36, which is further spaced from the bottom wall 24 interchangeably referred to as floor 24. While two platforms 28 and 36 are illustrated in this embodiment it is not the intent to limit the number of platforms to two. For example, the tower structure 12 may have a single platform or more than two provided that sufficient safe operating space is provided for utilization by users of the zip line tower 12.

Still with respect to FIG. 3, an assent-descent means 38, here in the non-limiting form of a ladder along the interior of side wall 20 may be located in the interior space 26 to provide access from the floor 24 to the platforms 28, 36 and the exterior surface of top wall 22. The assent-descent means may extend from proximate the bottom wall to proximate the platforms 28, 36 and top wall 22. By proximate it is meant that a user may readily reach the assent-descent means 38 without assistance, for example where steps are provided a user need only step from the floor to the step or where a climbing rope is used the user may readily grip the rope while standing on the floor 24. As illustrated top wall 22 may also have a door 48 opening to allow access to the exterior surface of the top wall 22. Although a ladder 38 is depicted in this embodiment it is not the intent to limit the assent-descent means 38 to a ladder. Other, non-limiting embodiments may provide for a circular staircase surrounding a center pole running axially from the floor 24 to the top wall 22 or stair steps may run diagonally between platforms, or climbing ropes or rope ladders may be provided from the top wall 22 extending to the floor 24 through openings provided in the platforms such that a user may utilize the climbing rope or rope ladder to gain access to the platforms and exterior of top wall 22. Further, embodiments may provide that there are no ladders, steps or climbing ropes in the internal space 26 to gain access to a platform but instead access to the platforms may be provided by external structures on the side walls 20. By way of a non-limiting example access may be provided by a climbing wall such as a rock wall 58 (FIG. 5). Accordingly, the tower structure 12 may have no assent-descent means 38 in its internal space 26 or may have both internal assent-descent means and external assent-descent means for example by the rock climbing wall 58.

Still with respect to FIG. 3, at least one zip line 30 of the tower structure 12 is illustrated. Zip line 30 may be of any of the types understood by those skilled in the art that conform to ANSI/ANSEE standards and Federal Regulation for zip lines, for example flexible steel wire rope that is utilized as a mobile zip line or fixed zip line. By mobile zip line it is meant a zip line 30 that may be readily moved from one location to another and is not fixed in single location. By fixed zip line it is meant that the zip line 30 is not readily moveable from one location to another. One or more zip lines 30 may be present in an embodiment depending on the size of the tower structure 12, safety, and the number of anticipated users.

The zip lines 30 at their terminus end 32 may be mounted to the tower structure 12. Terminus end 32 may be interchangeably used with first end 32. By way of a non-limiting example FIG. 3 illustrates a beam 66 that may be connected or integral to side wall 20 utilizing an internal H beam and fastener 33 such as an eye bolt through which zip line 30 passes and is tied off or clamped. The beam 66 and eyebolt configuration is but one non-limiting example of the means known by those skilled in the art of releasably connecting zip lines 30 to tower structure 12. Accordingly, it is not the intent to limit the connection of the zip line cable 30 to that which is illustrated. While the terminus end 32 of the zip line cable 30 may be releasably connected or fixed to the tower structure 12, a second end (not illustrated) may be releasably connected to a tree or a second tower structure 12 (FIG. 6) to list just a few non-limiting examples that may provide a safe zip line ride for a user who typically stands on the platform 28 underneath the zip line cable 30 and connects (when preparing to depart the platform 28) or disconnects to the carriage 56 (after arriving at the platform 28) via harness 58 (FIG. 5) or the like.

Still with respect to FIG. 3, the embodiment illustrates tower structure 12 is divided into three separate compartments. It is not the intent to limit the embodiments to three compartments as it may be readily appreciated that more or less compartments may be present depending on whether access to the platform 28, 36 is internal or external (as previously discussed) and depending on the number of platforms provided. The embodiment of FIG. 3 illustrates a bottom or first compartment defined by walls 20, floor 24 and platform 36. A second or middle compartment is defined by walls 20, platform 36 and platform 28. A third or top compartment is defined between top wall 22, platform 36 and side walls 20.

The compartmentalization advantageously provides for utilization of the compartment of the tower structure 12 for any number of uses. That is, the compartments may provide the storage capacity for various releasably connected components. For example, platform extensions, zip lines 30, harnesses 58, and carriages 56 to name just few examples. Such storage capacity allows for rapid disassembly of zip line tower 10 because of the proximity of the storage. Further, such storage permits the zip line tower 10 to be closed and secured for transport to the next venue where the same readily accessible storage allows for rapid low cost assembly of zip line tower 10 for use. Accordingly, the compartmentalization advantageously permits the zip line tower structure 12 to be self-contained, meaning it is capable of storing its releasably connected components in its interior space 26 for transport, removal of said component's for assembly, and storage after disassembly. Other embodiments provided with a selectively openable and closeable barrier 48 at the level of the bottom compartment in side wall 20 permit the bottom compartment to be advantageously utilized as a vending and or retail store area. For example, tickets for the ride or sale of merchandise may be made available to name just a few non-limiting examples of use for the compartments.

Still with reference to FIG. 3, in use, two of the side walls 20 are formed with selectively openable and closeable barriers 48 that when in their opened state permit zip lines 30 to extend therethrough from their releasable connections in the interior space 26 of the tower structure 12. The side walls 20 not visible in the figure may also have barriers 48 permitting zip lines 30 to extend therethrough.

Even though the tower structure 12 is free standing in its second configuration, when in use, embodiments may also provide that tower structure 12 is configurable to releasably attach a stabilizing element/s 50 for stabilizing the tower structure 12. By way of a non-limiting example, as illustrated in FIG. 3, outriggers 50 may be releasably attached to side wall 20 for extension to ground 16. Other non-limiting stabilizing elements may include cables or any means known in the art for providing stabilization to a vertical tower provided the tower structure 12 is readily detached from such stabilizing element 50 for transport to another venue for use. As can be readily appreciated, though the tower structure 12 is free standing, the addition of stabilizing elements 50 may be desirable during various operating conditions such as large number of users or when high winds are present or with unstable ground to name just a few non-limiting examples.

Figure 4:
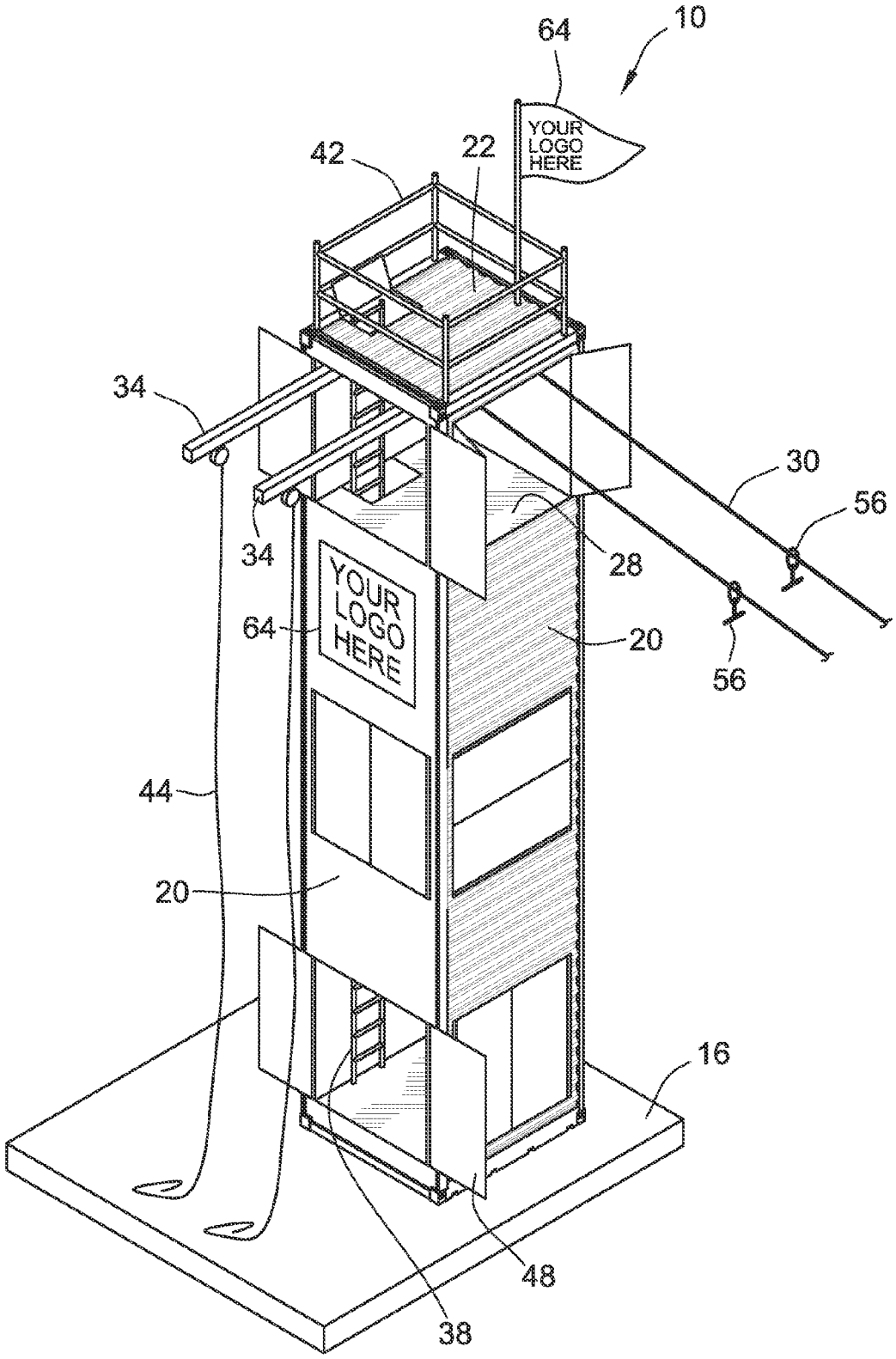
FIG. 4 is a perspective view of an embodiment of a portable zip line tower of the present invention.

Turning now to FIG. 4, yet another embodiment of the present invention is illustrated. In this embodiment, an at least one free fall support structure 34 is illustrated. The free fall support structure 34 is generally made of a steel or a comparable metal and formed as a bar or an I or H beam to name a few non-limiting examples that may be utilized as readily understood by those skilled in the art. The free fall support structure 34 has an interior portion in the internal space 26 that may be releasable connected to the tower structure 12. Thus, tower structure 12 is configurable to receive, that is mount, the interior portion of the free fall support structure 34 while a second portion may extend through the selectively openable and closeable barriers 48 to outside the tower structure 12. The interior portion of the free fall support structure 34 may be connected to the tower structure 12, for example to the interior surface of top wall 22 or under a platform by any known means, for example screws, fasteners, welds or slots permitting the tower structure 12 to slideably receive the support structure 34. Further, the free fall support structure 34 may be configurable to retract telescopically or simply fold in itself such that no part of the free fall support structure 34 extends beyond the side walls 20 and thereby permitting the tower structure 12 to be sealed closed for weather proofing and transportation. The external portion of free fall support structure 34 may releasably connect to a free fall line 44 and brake or auto belay 68. Thus, as readily understood by those skilled in the art, free fall structures 34 allow users wear a safety harness 58 that releasably connects to an active or passive brake system 68 and free fall line 44 which actively or passively arrests the user's fall so as to control vertical drop from a platform or top wall 22 to the ground 16. Thus, free fall support structure 34 may be utilized by users of zip line tower 12 in free fall activities along a side wall 20 or to support free fall lines 44 that act as a safety, that is brake line while climbing the side wall 20 configured as a rock climbing wall 52 (FIG. 5).

In the embodiment illustrated in FIG. 4 the plurality of walls 20, 22, 24 of tower structure 12 advantageously permits adjacent side walls 20 to be utilized for different rides/uses. Specifically, in the embodiment shown a side wall 20 has a support structure 34 extending through it to permit a user to free fall from platform 28 or to participate in the zip line ride at adjacent side wall 20 through which zip line 30 extends. Meanwhile, on the side walls 20 not shown, free fall support structures 34 may be present or zip line rides or rock climbing walls 52. It is not the intent therefore to limit the embodiments to that which is illustrated in the figures as combinations of the plurality of walls 20, 22, 24 and platforms 28, 36 in combination with selectively openable and closeable barriers 48 are configurable to accommodate any number of combinations of free fall rides, climbing walls and zip line rides.

Further, yet another advantage provided by the plurality of walls of transportable tower structure 12 is top wall 22. The exterior surface of top wall 22 may be utilized as a floor or observation platform for users. As such, as illustrated in FIG. 4, an embodiment of top wall 22 is configurable to releasably mount safety rails 42 around the exterior surface of top wall 22 to protect the user from inadvertently stepping off the top wall 22. Other non-limiting configurations for top wall 22 allow for its use as a zip line safety platform or a platform to support advertisements 64 that may be as non-limiting examples signs or flags. Indeed any of the plurality of walls 20, 22, 24 may be utilized as locations for advertisements 64. As illustrated in FIG. 4, the plurality of side walls 20 permit a user to enter through selectively openable and closeable barrier 48 at ground level 16, climb ladder 38 and then proceed through selectively openable and closeable top barrier door 54 to reach platform 28. At platform 28 the user may advantageously have the option of utilizing free fall line 44, or zip line 30, or climb further up ladder 28 to platform 22 for observation. Moreover, at ground 16 the user may have the option of simply utilizing the side wall 20 as a climbing wall 52 (FIG. 5) together with free fall line 44 to climb to platform 28 and then either free fall or leave the platform 28 on zip line 30 of the zip line ride or utilize the ladder 38 to reach to top wall 22 for observation.

Turning now to FIG. 5, sidewalls 20 may also be configured or configurable to form a rock climbing wall 52. Rock structures 58 are spaced on a side wall to 20 to form rock climbing wall 52. Accordingly, as can be readily appreciated by those skilled in the art, users connect their harness 57 to free fall line 44 which in turn is connected to belay braking system 68 for safety so as to permit a safe climb of rock climbing wall 52. The rock structures 58 may be permanently attached to sidewalls 20, or as is known in the art, may be removable and replaced with plugs or similar structures (not illustrated) such that the sidewalls are still capable of sealing the interior space 26 from the weather and permitting intermodal transport. Yet, other embodiments provide that the rock structures 58 may be permanently fixed but still allow for transportation. Accordingly, the plurality of side walls 20 advantageously permit tower structure 12 to accommodate not only side walls 20 with zip lines 30 for zip line rides but as shown adjacent side walls 20 may also include rock climbing walls 52 thereby permitting different uses at adjacent side walls 20 and or opposing side walls 20.

Figure 6:
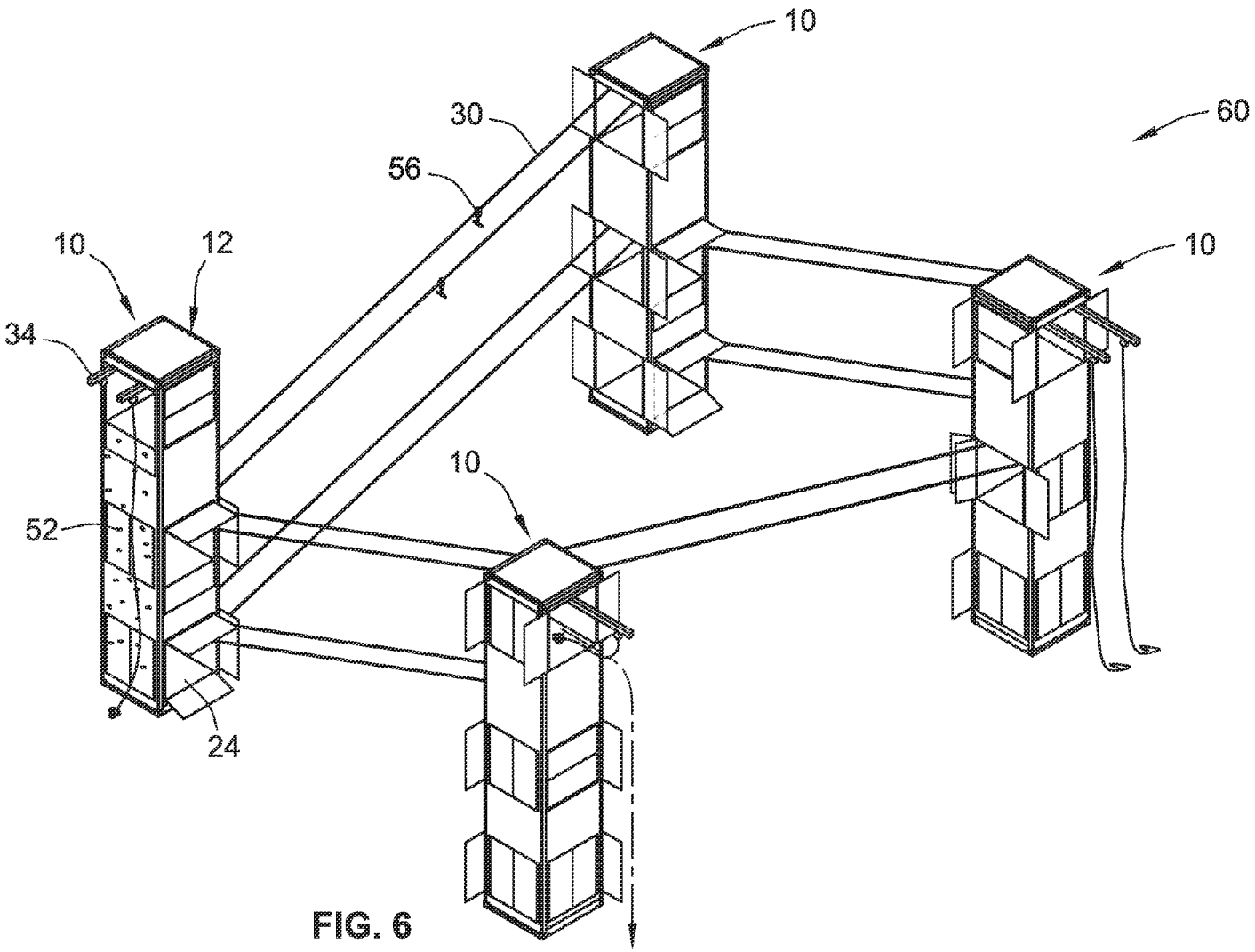
FIG. 6 is a perspective view of a zip line tour utilizing embodiments of portable zip line towers of the present invention.

Turning now to FIG. 6, a zip line tour 60 is illustrated utilizing embodiments of the portable zip line tower structure 12 as previously disclosed herein. Advantageously, each zip line tower may have any number of selectively openable and closeable barriers 48 formed in side walls 20 and top wall 22 as desired. As illustrated in FIG. 6 each side wall 20 has three selectively openable and closeable barriers 48 but this need not be the case. Other embodiments may have no selectively open and closeable barrier walls 48 or may have only 1 to discuss just a few of the possibilities. Advantageously, each zip line tower structure 12 may be self-contained and readily sealable so as to have its interior space 26 protected from the weather and to permit ready transportation from one venue to another for ease of assembly and disassembly with no permanent structures in the ground.

Figure 7A:
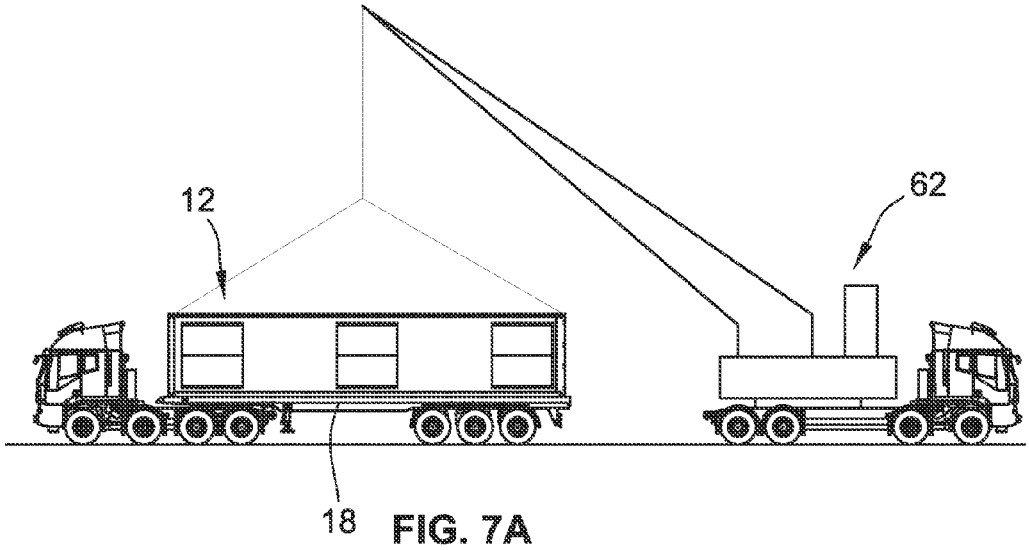
FIG. 7A and FIG. 7B are schematic illustrations of an embodiment of a method of the present invention utilizing a crane to move an embodiment of a portable zip line tower of the present invention.
Figure 7B:
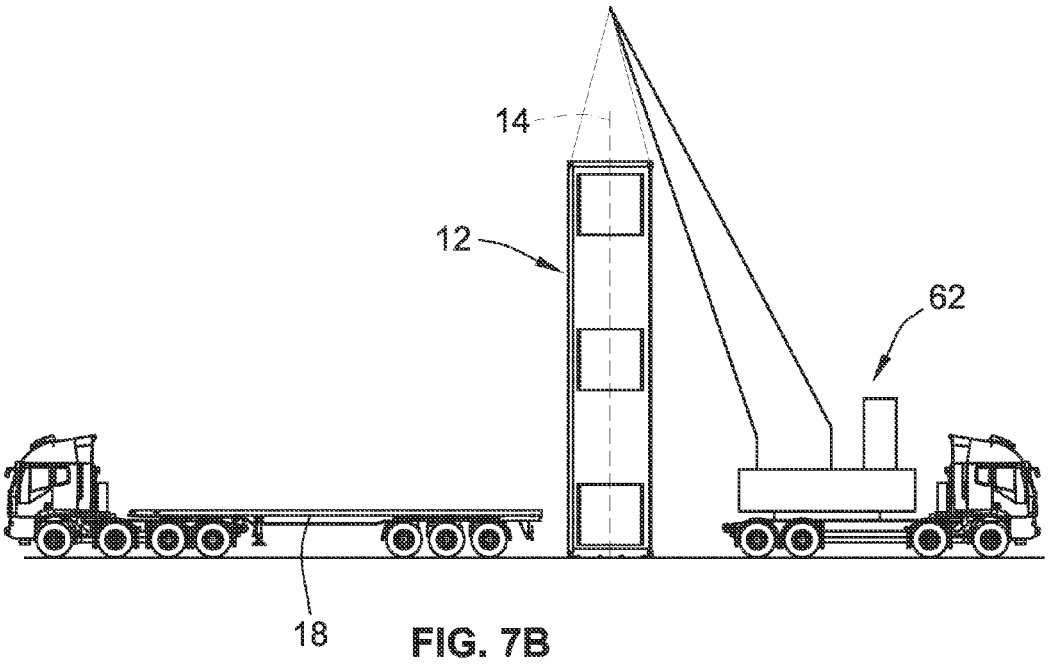

Turning now to FIGS. 7A. and 7B, schematic illustrations of an embodiment of a method of the present invention utilizing a crane 62 are shown. In FIG. 7A the tower structure 12 is shown in its first configuration laying down on the tractor trailer bed. Crane 62 is illustrated as a non-limiting example of the means by which the tower structure 12 is configured in its second configurable state, that is as shown in FIG. 7B tower structure 12 is standing up such that its major longitudinal access 14 extends from the ground vertically to the top wall 22 free of the tractor trailer 18 and then the crane 62 (see FIG. 2) such that the tower structure 12 is free standing.

Further, embodiments of tower structure 12 may be configurable (not illustrated) to accept drinking water or water for sanitation, remove grey water, and to receive electricity for various functions including lighting (not illustrated).

To reiterate, portable zip line tower 10 as disclosed in the various embodiments advantageously provide a low cost portable zip line tower 10 in part because embodiments of the present tower structure 12 are readily available as low cost containers that can be readily modified. Further, the cost of building fixed zip line rides in multiple geographic locations is avoided because the portable zip line tower 10 may be advantageously transported from one venue to the next because unlike traditional zip line towers it is not permanently fixed in the ground and thus its tower structure 12 with its plurality of walls provides the free standing capability that avoids the labor costs associated with constructing a permanent tower or purchase of the real estate to establish such permanent structures.

Thus, embodiments of the zip line tower 10 are advantageous over traditional fixed zip line rides that must have support structures permanently fixed in the ground limits and as such are not readily transportable. Moreover embodiments of the present invention are free standing and do not require either the means of transport or permanent support structures to for use as tower support structures.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A portable zip line tower comprising:

a tower structure having a major longitudinal axis, the tower structure configurable into a first configuration wherein the major longitudinal axis is generally parallel to ground and a second configuration wherein the major longitudinal axis is generally perpendicular to ground;

at least one platform mounted at least partially within an interior space of the tower structure; and wherein the tower structure is configured for mobile transportation in the first configuration.

2. The portable zip line tower of claim 1, wherein the tower structure includes four side walls, a top wall, and a bottom wall defining the interior space.

3. The portable zip line tower of claim 2, wherein at least one selectively openable and closeable barrier is formed in at least one of the plurality of walls proximate the platform.

4. The portable zip line tower of claim 2, wherein the at least one platform is mounted such that the at least one zip line cable of the portable zip line tower terminates proximate the at least one platform.

5. The portable zip line tower of claim 2, wherein in the second configuration at least one free fall support structure is releasably connected to the tower structure and extends generally perpendicular to at least one of the four side walls.

6. The portable zip line tower of claim 2, wherein at least one of the four side walls is a rock climbing wall.

7. The portable zip line tower of claim 3, wherein a second platform is at least partially within the interior space and wherein the second platform is mounted spaced apart from the top, the bottom and the first platform.

8. A portable zip line tower, comprising:

a tower structure comprising a plurality of walls which surround and enclose an interior space;

at least one platform mounted at least partially within the interior space, the at least one platform mounted such that at least one zip line cable of the zip line tower terminates proximate the at least one platform; and at least one selectively openable and closeable barrier formed in at least one of the plurality of walls, the at least one selectively openable and closeable barrier providing access to said at least one platform.

9. The portable zip line tower of claim 8, wherein the plurality of walls are four side walls, a top wall and a bottom wall.

10. The portable zip line tower of claim 8, wherein a second platform spaced from the first platform the top and the bottom is mounted at least partially within the interior space.

11. The portable zip line tower of claim 8, wherein the tower structure has a major longitudinal axis, the tower structure configurable into a first configuration wherein the major longitudinal axis is generally parallel to ground and a second configuration wherein the major longitudinal axis is generally perpendicular to ground.

12. The portable zip line tower of claim 11, wherein the tower structure is configured for mobile transportation in the first configuration.

13. The portable zip line tower of claim 8, wherein the at least one selectively openable and closeable barrier is formed in the top wall.

14. The portable zip line tower of claim 8, wherein the at least one selectively openable and closeable barrier is formed in one of the side walls.

15. The portable zip line tower of claim 8, wherein assent-descent means for reaching the at least one platform extend from proximate the bottom wall to proximate the first platform.

16. The portable zip line tower of claim 8, wherein the at least one zip line is removably connected to the tower structure.

17. The portable zip line tower of claim 8, wherein at least one free fall support structure is releasably connected to the tower structure and extends generally perpendicular to at least one of the plurality of walls.

18. The portable zip line tower of claim 8, wherein at least one of the plurality of walls is a rock climbing wall.

19. The portable zip line tower of claim 8, wherein at least one of the plurality of walls displays advertisements.

20. A portable zip line tower, comprising:

a tower structure comprising a plurality of walls which surround and enclose an interior space;

at least one platform mounted at least partially within the interiors space, the at least one platform mounted such that at least one zip line cable of the zip line tower terminates proximate the at least one platform; and at least one selectively openable and closeable barrier formed in at least one of the plurality of walls, the at least one selectively openable and closeable barrier providing access to said at least one platform;

wherein the at least one selectively openable and closeable barrier is formed in one of the side walls; and wherein a second selectively openable and closeable barrier is formed in the top wall.

21. A method for operating a portable zip line tower of claim 1, the method comprising the steps of: removing the zip line tower from a mobile transport; and standing up the zip line tower such that a major longitudinal axis of the zip line tower extends generally normal to the ground.

* * * * *